US006427930B1

(12) United States Patent
Mei et al.

(10) Patent No.: US 6,427,930 B1
(45) Date of Patent: Aug. 6, 2002

(54) DEVICE FOR CONNECTION OF A NOZZLE OF A PRE-MIXING CHAMBER OF A GAS TURBINE, TO A HOUSING OF THE PRE-MIXING CHAMBER

(75) Inventors: Luciano Mei, Sesto Fiorentino; Alessio Miliani, Impruneta, both of (IT)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/579,509

(22) Filed: May 26, 2000

(30) Foreign Application Priority Data

May 31, 1999 (IT) ..... MI99A1209

(51) Int. Cl.[7] ..... B05B 7/10

(52) U.S. Cl. ..... 239/403; 239/398; 239/419; 239/423; 239/600; 60/39.23; 60/39.31

(58) Field of Search ..... 239/390, 397, 239/398, 403, 404, 419, 423, 424, 430, 600; 60/39.31, 737, 740, 39.23

(56) References Cited

U.S. PATENT DOCUMENTS 4,044,553 A * 8/1977 Vaught ..... 60/39.23
4,466,240 A * 8/1984 Miller ..... 60/39.31
5,139,416 A 8/1992 Wagner et al.
5,218,824 A * 6/1993 Cederwall et al. ..... 239/403 X
5,343,694 A * 9/1994 Toborg et al. ..... 60/39.31
5,398,496 A * 3/1995 Taylor et al. ..... 60/39.31
5,613,363 A 3/1997 Joshi et al.
5,671,597 A 9/1997 Butler et al.
5,701,733 A * 12/1997 Lewis et al. ..... 60/39.31

FOREIGN PATENT DOCUMENTS

EP 0 588 629 A1 9/1994

* cited by examiner

*Primary Examiner*—Steven J. Ganey
(74) *Attorney, Agent, or Firm*—Nixon & Vanderhye

(57) ABSTRACT

A device (31) for connection of a nozzle (23) of a pre-mixing chamber (11) of a gas turbine, to a housing (12) of the pre-mixing chamber (11) comprises a flange (33) which clasps and retains the nozzle (23). The flange (33) is connected in a detachable manner to the housing (12) of the pre-mixing chamber (11), so as to render the nozzle (23) integral with the housing (12) of the pre-mixing chamber (11).

11 Claims, 4 Drawing Sheets

DEVICE FOR CONNECTION OF A NOZZLE OF A PRE-MIXING CHAMBER OF A GAS TURBINE, TO A HOUSING OF THE PRE-MIXING CHAMBER

The present invention relates to a device for connection of a nozzle of a pre-mixing chamber of a gas turbine, to a housing of the pre-mixing chamber.

It is known that gas turbines comprise a compressor, to which air is supplied from the external environment in order to pressurise the compressor. The compressed air passes into a series of pre-mixing chambers, which end in a nozzle, in each of which an injector supplies fuel which is mixed with the air in order to form an air/fuel mixture to be burnt. When the mixture passes through the nozzle, it enters the combustion chamber, where it burns, and produces gases with a high level of enthalpy, which are expanded in a turbine. The turbine transforms the enthalpy of the gases into mechanical energy which is available to a user.

The present invention relates in particular to nozzles which admit the mixture which is formed in the pre-mixer inside the combustion chamber, and to the device for connection of the nozzles to a housing of a pre-mixing chamber. These nozzles consist of generally converging elements, and are commonly known as shrouds.

In order to make apparent the technical problems which are covered by the present invention, hereinafter a brief description is provided of a single pre-mixing unit 10, with reference to FIG. 1.

The pre-mixing unit 10 comprises a pre-mixing chamber 11, which is defined by a housing 12 integral with a column-type support 13. The column-type support 13 ends in a plate 14, in which there are provided through holes 15 for attachment to a motor body, not shown, and a pair of through holes 16 which constitute the ends of pipes 17, 18 for supply of the fuel.

One pipe 17 opens into an annular chamber 19, from which, via through holes 20, a portion of the fuel is supplied to an air agitator device 21, generally indicated as a swirler. In the swirler 21 and the pre-mixing chamber 11, there is produced the mixture consisting of air with a high level of turbulence obtained from the compressor, and a portion of fuel supplied via the swirler 21.

The swirler 21 generally consists of two separate concentric blade elements: an outer element 21*a* is provided with blades which are oriented in one direction, whereas an inner element 21*b*, which is inserted on a shaped ogival element 22, is provided with blades which are oriented in the opposite direction.

The different orientation of the blades of the two elements 21*a* and 21*b* of the swirler 21 makes it possible to obtain downstream from the swirler 21 itself, in the pre-mixing chamber 11, a high level of turbulence which creates ideal conditions for obtaining a highly dispersed air-fuel mixture, and thus satisfactory combustion. It will be appreciated that, as shown in FIG. 1, the through holes 20 admit the fuel into the outer element 21*a* of the swirler 21.

The column-type support 13 has another pipe 18 which supplies to a series of pipes, which, in conventional embodiments (not shown in FIG. 1) open inside the nozzle 23. More particularly, these pipes open in the vicinity of a mouth of the nozzle 23, which faces the combustion chamber of the turbine.

The pre-mixing chambers, and in particular the nozzles in which these chambers end, and by means of which they are connected to the combustion chamber, are parts of the turbines which are subject to thermal stress.

Since the flame in the combustion chamber is kept anchored in the vicinity of the nozzle, it transmits high thermal loads to all the elements of the pre-mixing unit, and in particular to the nozzle which is the element closest to it.

The foregoing makes apparent the fact that since the nozzle is the element which is under the greatest mechanical and thermal stress, it is also the element which is destined to become worn and damaged most.

For this reason, the nozzles generally consist of elements which are separate from the housing of the pre-mixing chamber, and are connected to the latter in a removable or detachable manner, such that they can be maintained, and when necessary replaced.

In the conventional embodiments, the nozzle is connected directly to the housing of the pre-mixing chamber. This means that removal of the connection and separation of the nozzle from the housing of the pre-mixing chamber are somewhat lengthy and difficult. In addition, in order to be able to produce sealed connections between the nozzle and the housing, accurate work is necessary, which is substantially lengthy, difficult and costly.

The object of the present invention is to eliminate the above-described technical disadvantages, by providing a device for connection of a nozzle of a pre-mixing chamber of a gas turbine, to a housing of the pre-mixing chamber, which makes it possible to carry out rapid, simple connections of the nozzle to the housing of the pre-mixing chamber.

Another object of the invention is to provide a device for connection of a nozzle to a pre-mixing chamber of a gas turbine, to a housing of the pre-mixing chamber, which makes it possible to disconnect the nozzle from the housing of the pre-mixing chamber in a substantially fast, simple manner.

A further object of the invention is to provide a device for connection of a nozzle of a pre-mixing chamber of a gas turbine, to a housing of the pre-mixing chamber, which makes it possible to maintain and optionally replace the nozzle of the mixing unit in a substantially fast, simple manner.

A further object of the invention is to -provide a device for connection of a nozzle of a pre-mixing chamber of a gas turbine, to a housing of the pre-mixing chamber, which is substantially simple, safe and reliable.

This and other objects of the present invention are achieved by providing a device for connection of a nozzle of a pre-mixing chamber of a gas turbine, to a housing of the pre-mixing chamber, characterised in that it comprises at least one flange which clasps and retains the said nozzle, the said flange being connected in a detachable manner to the said housing of the said pre-mixing chamber, so as to render the said nozzle integral with the said housing of the said pre-mixing chamber.

According to a preferred embodiment, the flange is produced by means of a bush element, in which the nozzle is inserted, with one of the ends connected in a non-detachable manner to the nozzle, and the other end connected in a detachable manner to the pre-mixing chamber.

According to another preferred embodiment, the nozzle has an annular cavity, which is surrounded by the bush element. Between the annular cavity of the nozzle and the bush element, there is provided a distribution chamber, which can be supplied with fuel by a first pipe, and from which the fuel is discharged, and is admitted into the combustion chamber downstream from the nozzle, via second pipes.

Further characteristics of the device for connection according to the invention are also defined in the claims.

Advantageously, the device for connection according to the present invention is not only economical in terms of its production, but also because it makes it possible to carry out interventions on the nozzle or on the housing of the pre-mixing chamber in a manner which is substantially more economical than according to the known art.

Further characteristics and advantages of a device for connection of a nozzle of a pre-mixing chamber of a gas turbine, to a housing of the pre-mixing chamber, according to the present invention, will become more apparent from the following description provided by way of non-limiting example, with reference to the attached schematic drawings, in which.

Figure 1:
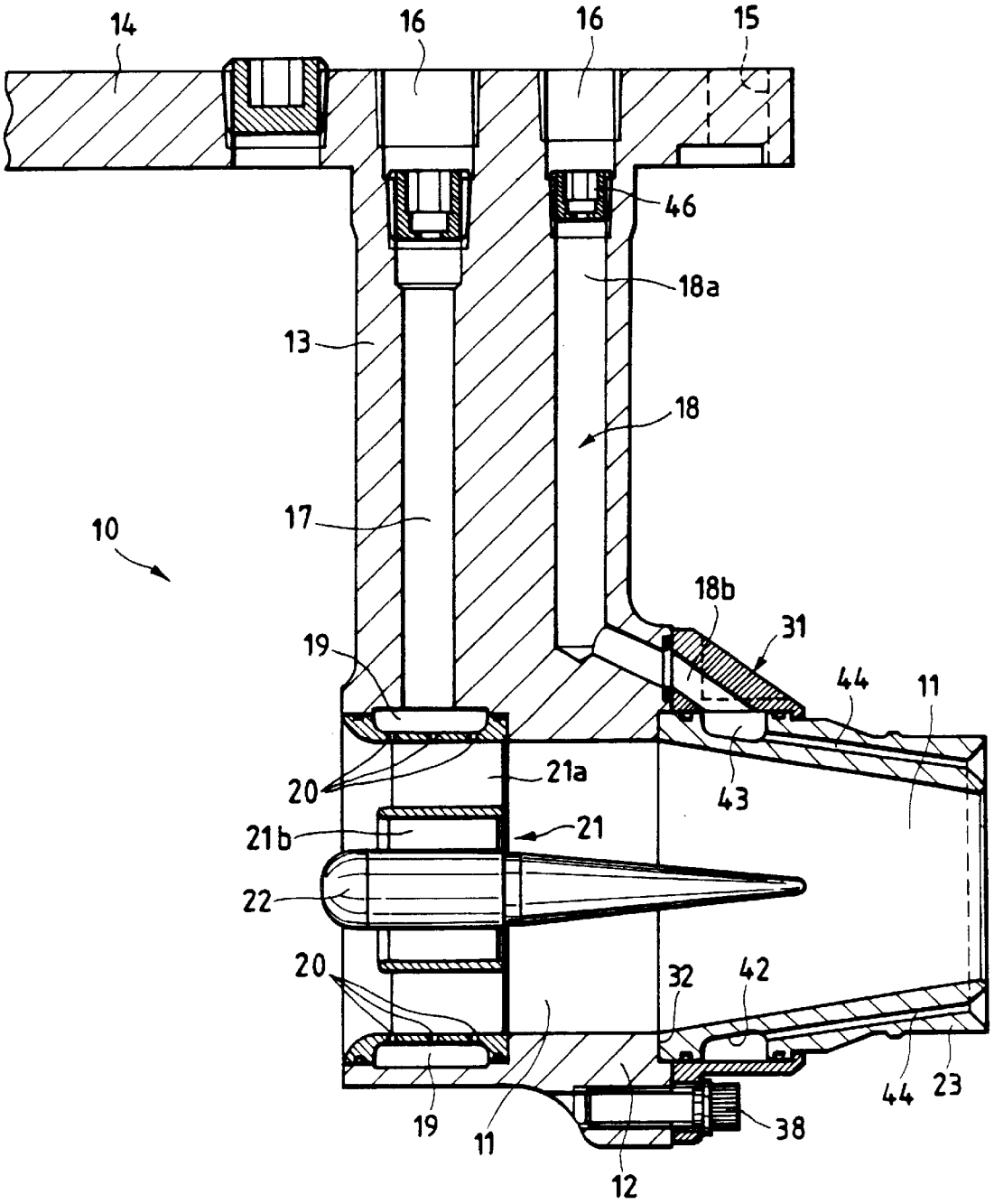
FIG. 1 shows a lateral elevated cross-section of a pre-mixing unit, with a nozzle mounted on a housing of a pre-mixing chamber, by means of a device for connection according to the invention.
Figure 2:
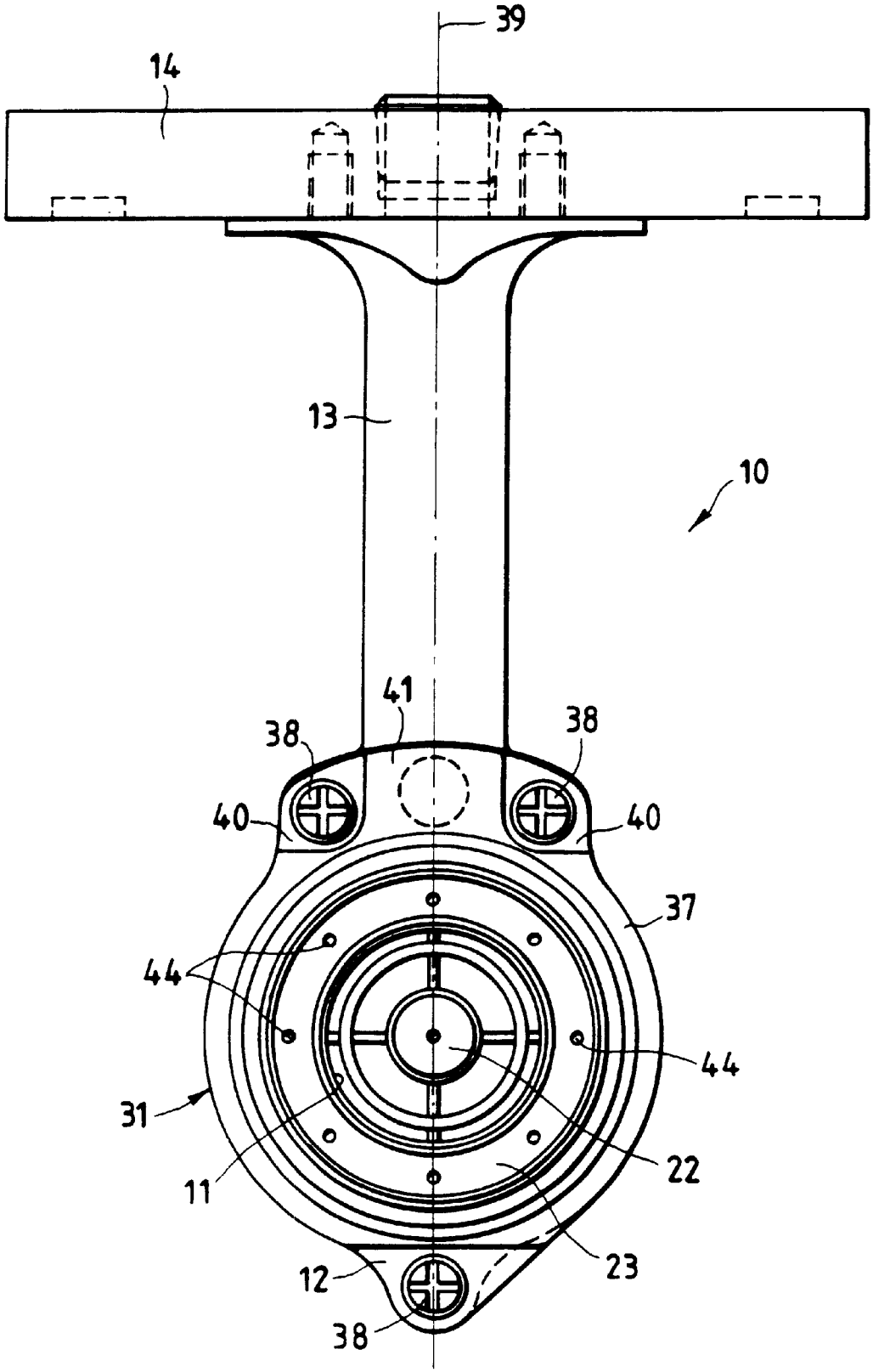
FIG. 2 shows a front elevated view of the pre-mixing unit shown in FIG. 1.
Figure 3:
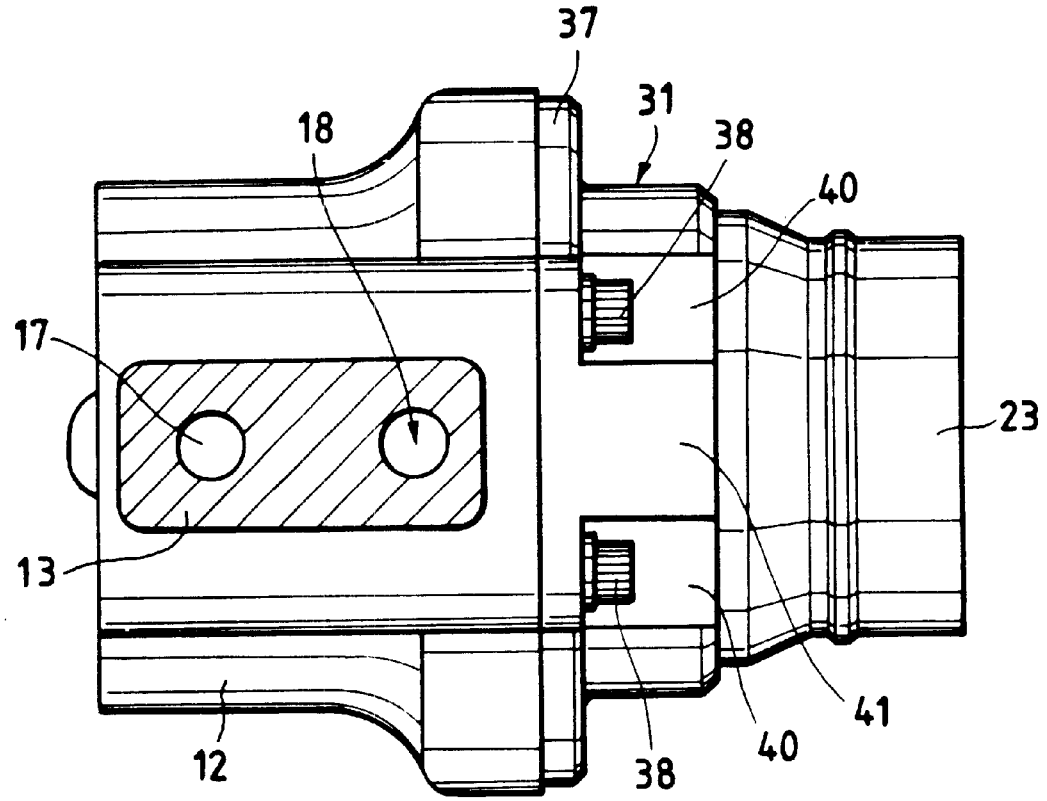
FIG. 3 shows a cross-section in plan view of the mixing unit shown in FIG. 1.
Figure 4:
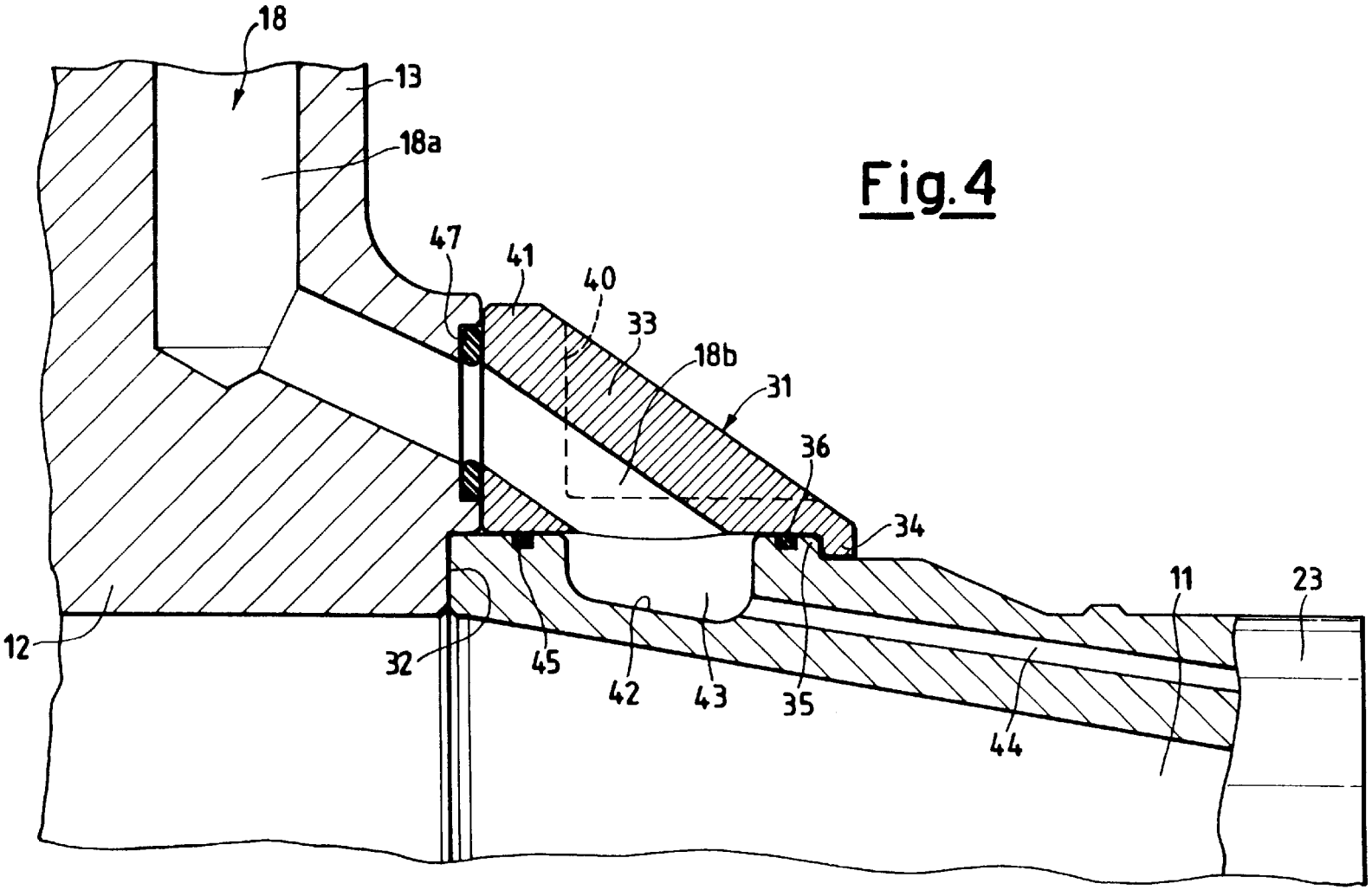
FIG. 4 shows a cross-section of a detail of the device for connection according to the invention.

The aforementioned Figures show a device for connection of a nozzle of a pre-mixing chamber of a gas turbine, to a housing of the pre-mixing chamber, which is indicated as 31 as a whole.

The nozzle 23 is connected at the front to the housing 12 of the pre-mixing chamber 11, and is accommodated in an annular seat 32 provided at the end of the housing 12 of the pre-mixing chamber 11.

The device 31 substantially consists of a flange 33, which on one side clasps and retains a nozzle 23 in a non-detachable manner, and on the other side is connected in a detachable manner to a housing 12 of the pre-mixing chamber 11, such as to render the nozzle 23 integral with the housing 12.

The flange 33 is produced by means of a bush element in which the nozzle 23 is inserted, with the ends of the bush element connected on one side to the nozzle 23, and on the other to the housing 12.

One end of the bush element 33 is provided with an edge 34 which projects towards the interior of the bush element 33 itself, such as to form a shoulder, against which a projecting portion 35 of the nozzle 23 abuts.

The edge 34 extends along the entire periphery of the bush element 33, and is also annular.

The projecting portion 35 is also annular, and has circumferential brazing 36, to secure the bush element 33 onto the nozzle 23.

On the other hand, a second end of the bush element 33 supports a plate extension 37, which projects towards the exterior of the bush element 33, and abuts a front portion of the housing 12. In this extension 37 there are provided three through holes, which are aligned with an equivalent number of through holes provided in the housing 12, in which screws 38 are inserted as threaded locking elements. The screws 38 are locked in a threaded portion of the through holes provided in the housing 12 of the pre-mixing chamber 11, such as to form the detachable connection between the nozzle 23 and the housing 12 of the pre-mixing chamber 11.

Two of the three holes of the bush element 33, and thus also of the housing 12, are provided in a position which is symmetrical relative to an axis of symmetry 39 of the device 31 and of the pre-mixing unit 10, in a part in which the housing 12 is connected to a column-type support 13 of the pre-mixing unit 10. These holes open into recesses 40 provided in an enlarged portion 41 of the plate extension 37.

The third hole is provided in line with the axis of symmetry 39, and also in a part opposite that in which the column-type support is connected to the housing 12 of the pre-mixing chamber 11, where the first two holes are provided.

Along the nozzle 23, and at the projecting portion 35 there is provided an annular cavity 42, which is surrounded by the bush element 33. The annular cavity 42, which is closed by the bush element 33, forms a distribution chamber 43, which communicates with a pipe 18 provided in the column-type support 13, and with further pipes 44 provided inside the body of the nozzle 23. The pipes 44 open into the combustion chamber, on a front portion of the body of the nozzle 23.

The pipe 18 supplies fuel into the distribution chamber 43, and from there the fuel is distributed via the pipes 44 into the combustion chamber, such as to feed a pilot flame, which usually has an annular shape, and surrounds a main flame formed by combustion of the fuel distributed by the injector 22.

In the embodiment shown by way of non-limiting example, there are eight pipes 44, provided inside the body of the nozzle 23, around the circumference, and equidistant from one another on the latter.

Parallel to the cavity 42 which forms the distribution chamber 43, the nozzle 23 has a second annular enlarged portion, on which there is provided second brazing 45, to secure the bush element 33 onto the nozzle 23. Both the brazing 36 and the brazing 45, which connect the bush element 33 to the nozzle 23, guarantee sealing inside the distribution chamber 43.

The distribution chamber 43 is supplied by the pipe 18. The pipe 18 has two portions: a first position 18*a* is provided in the column-type support 13. The portion 18*a* has at one end an element 46 for connection to external piping leading to the pre-mixing unit 10 and on the other hand the opposite end ends with an enlargement which constitutes a seat to accommodate a sealing "elicoflex" 47, between the first portion 18*a* of the pipe 18, and a second portion 18*b* provided on the bush element 33.

The "elicoflex" consists of a toroidal or doughnut-shaped body, made of material suitable for providing the seal, inside which there is provided a resilient element. When the "elicoflex" is accommodated in its seat, the resilient element tends to expand, thus forcing the sealing surfaces of the toroidal element against the seat. By this means, an optimum seal is guaranteed even in extreme conditions.

The pipe 18*b* is provided in the enlarged portion 41 of the plate extension 37, between the pair of through holes, which are symmetrical relative to the axis 39. The pipe 18*b* consists of a preferably oblique through hole, which has a first mouth on the wall of the plate extension 37, at the pipe 18*a*, and a second mouth at the cavity 42.

Fitting and detachment of a device for connection of a nozzle of a pre-mixing chamber of a gas turbine, to a housing of the pre-mixing chamber, according to the invention, are extremely simple and quick, and in particular, take place as described hereinafter.

Fitting is carried out by accommodating the nozzle 23, which is integral with the bush 31, in the seat 32 of the housing 12 of the pre-mixing chamber 11, after having previously positioned the "elicoflex" 47. The screws 38 are then inserted in the corresponding holes in the plate extension 37, and are tightened inside the threaded holes of the housing 12. Subsequently the connections formed are tightened in order to prevent rotation of the screws.

Detachment takes place by removing the screws 38 and then disconnecting the bush element 33, which is integral with the nozzle 23, for maintenance and/or replacement, as required.

In a known manner, during functioning of a gas turbine which contains the device for connection of a nozzle of a pre-mixing chamber of a gas turbine, to a housing of the pre-mixing chamber, according to the invention, fuel is supplied via the pipe 17 to the outer element 21*a* of the swirler 21. The fuel passes into the pre-mixing chamber 11, in which a mixture of air and fuel is formed. Formation of the mixture is assisted by the turbulence of the air, caused by the swirler 21. Subsequently, the mixture passes through the nozzle 23, and into the combustion chamber, where it burns. The bush element 33 according to the invention compensates for all the stresses which are exerted on the nozzle 23, and keeps it locked in a firm, secure manner on the housing 12 of the pre-mixing chamber 11.

In addition, via the pipe 18, fuel is supplied inside the distribution chamber 43. From there, via the pipes 44, the fuel passes into the combustion chamber, where it feeds the pilot flame. The seal between the portions 18*a* and 18*b* of the pipe 18 is guaranteed by the "elicoflex" 47. In addition, the seal of the distribution chamber 43 is guaranteed by the brazings 36, 45 interposed between the nozzle 23 and the bush element 33.

It will be appreciated that modifications and variants are possible, such that the bush element 33 can be rendered integral with the nozzle 23 by micro-fusion, thus making it unnecessary to produce the brazings 36, 45. In addition, the bush element 33 can be locked onto the housing 12 of the pre-mixing chamber 11 by means of any number of screws 38, according to the contingent design requirements, and in different embodiments, it can be locked by means of bolts or other elements which are easy to dismantle.

The embodiment described relates to a turbine supplied with gaseous fuel, and it will be appreciated that the device for connection according to the present invention can advantageously also be applied to a turbine which is supplied with liquid fuel. In this embodiment, the shaped ogival element 22 is an injector.

In practice, it has been found that a device for connection of a nozzle of a pre-mixing chamber of a gas turbine, to a housing of the pre-mixing chamber, according to the invention, is particularly advantageous, because it makes it possible to simplify considerably the operations of maintenance of the turbine, and also makes it possible optionally to carry out replacement of the nozzle of the pre-mixing unit, in a manner which is substantially simple and quick.

In addition, although the pipe which supplies to the distribution chamber is produced in two separate portions, it has optimum sealing characteristics. This is obtained by using the "elicoflex" ring, which even in adverse operating conditions guarantees a high level of reliability.

To this there must also be added the considerable economic viability and reliability of the device.

A device thus designed, for connection of a nozzle of a pre-mixing chamber of a gas turbine, to a housing of the pre-mixing chamber, can be subjected to many modifications and variants, all of which come within the scope of the invention; in addition, all the details can be replaced by elements which are technically equivalent.

In practice, any materials and dimensions can be used, according to the technical requirements.

What is claimed is:

1. A pre-mixing unit for a gas turbine comprising a housing for a pre-mixing chamber, a nozzle downstream from the housing forming part of the pre-mixing chamber, a device for connection of the nozzle to the housing, said device including at least one flange which clasps and retains said nozzle to said housing, said flange being detachably connected to said housing of the premixing chamber to render said nozzle integral with said housing of said pre-mixing chamber.

2. A pre-mixing unit according to claim 1 wherein said flange includes a bushing having an opening for receiving said nozzle, the ends of said bushing being connected in a non-detachable manner on one side to said nozzle and in a detachable manner on an opposite side to said housing.

3. A pre-mixing unit according to claim 2 wherein said nozzle has a projecting portion, said bushing including a first end having an edge which projects inwardly to form a shoulder for abutting said projecting portion of said nozzle, said bushing including a second end having a plate extension which projects outwardly and has through-holes, said bushing abutting a front portion of said housing with the through-holes aligned with holes in said housing, and threaded locking elements received in said through-holes in said bushing and in said holes of said housing to form said detachable connection between said nozzle and said housing.

4. A pre-mixing unit according to claim 3 wherein said projecting portion of said nozzle is substantially annular.

5. A pre-mixing unit according to claim 3 including a column support connected to said housing, said bushing having three through-holes, a pair of said through-holes being provided symmetrically relative to an axis of symmetry along said column support, and a third hole provided in line with the axis of symmetry of said bushing and in a part of said housing remote from the connection between said column support and said housing.

6. A pre-mixing unit according to claim 2 wherein said nozzle has an annular cavity about which said bushing is superimposed defining a distribution chamber between said cavity and said bushing for receiving fuel from a first passage for discharge through a plurality of second passages in said nozzle into a combustion chamber downstream of said nozzle.

7. A pre-mixing unit according to claim 6 including a weld or brazing accommodated in a seat on said nozzle interposed between said nozzle and said bushing and substantially along each of the two sides of said distribution chamber.

8. A pre-mixing unit according to claim 6 wherein said bushing has an enlarged portion disposed between said pair of through-holes, said enlarged portion having a hole forming an end portion of said fuel supply passage for said distribution chamber.

9. A pre-mixing unit according to claim 8 wherein said through-hole which forms the end portion of said fuel supply passage is connected to a second portion of said supply passage within said column support, and a seal between said hole which forms said end portion of the supply passage and the second portion of the supply passage.

10. A pre-mixing unit according to claim 6 wherein said second passages are disposed within said nozzle and open into the combustion chamber on a confronting face portion of said nozzle.

11. A pre-mixing unit according to claim 1 wherein said nozzle includes at least one annular cavity connected to at least a first fuel supply passage, a plurality of second passages in said nozzle in communication with said cavity for distribution of the fuel to a combustion chamber downstream of said nozzle.

* * * * *